US007584625B2

(12) United States Patent
Wu et al.

(10) Patent No.: US 7,584,625 B2
(45) Date of Patent: Sep. 8, 2009

(54) COMPRESSOR CAPACITY MODULATION SYSTEM AND METHOD

(75) Inventors: Man Wai Wu, Hong Kong (CN); Gnanakumar Robertson Abel, Laguna City (CN); Ka Yiu Lau, Hong Kong (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 650 days.

(21) Appl. No.: 11/256,636

(22) Filed: Oct. 21, 2005

(65) Prior Publication Data

US 2007/0089443 A1 Apr. 26, 2007

(51) Int. Cl.
*F25B 49/00* (2006.01)

(52) U.S. Cl. ..... 62/228.1

(58) Field of Classification Search ..... 62/228.1
See application file for complete search history.

(56) References Cited

U.S. PATENT DOCUMENTS

| | | | | | |
|---|---|---|---|---|---|
| 3,350,896 | A | * | 11/1967 | Harnish | 62/200 |
| 4,184,341 | A | * | 1/1980 | Friedman | 62/175 |
| 4,672,822 | A | * | 6/1987 | Iijima et al. | 62/468 |
| 4,916,916 | A | * | 4/1990 | Fischer | 62/199 |
| 6,047,556 | A | * | 4/2000 | Lifson | 62/196.2 |

* cited by examiner

*Primary Examiner*—William C Doerrler
(74) *Attorney, Agent, or Firm*—Harness, Dickey & Pierce, P.L.C.

(57) ABSTRACT

A compressor system includes a compressor having an inlet, a first conduit fluidly coupled to the inlet, an accumulator fluidly coupled to the inlet by a second conduit, and a first valve disposed in the second conduit that prevents fluid communication between the accumulator and the inlet in a closed state and permits fluid communication between the accumulator and the inlet in an open state.

25 Claims, 2 Drawing Sheets

COMPRESSOR CAPACITY MODULATION SYSTEM AND METHOD

FIELD

The present teachings relate to compressors and, more particularly, to a capacity-modulated compressor.

BACKGROUND

Compressors may be used in a wide variety of industrial and residential applications to circulate refrigerant within a refrigeration, heat pump, HVAC, or chiller system (generically "refrigeration systems") to provide a desired heating or cooling effect. In any of the foregoing applications, the compressor may be used in conjunction with a capacity modulation system that adjusts a capacity of the compressor based on system demand.

Conventional capacity modulation systems selectively adjust the ability of the compressor to circulate refrigerant through the refrigeration system and therefore adjust the ability of the refrigeration system to absorb and reject heat. Conventional capacity modulation systems may therefore be used to adjust a capacity of the refrigeration system based on a required heating and/or cooling demand. Regulating compressor capacity based on system demand improves the efficiency of the compressor as only that amount of energy that is required is consumed.

Conventional capacity modulation systems may adjust compressor capacity by regulating a pressure within a compressor housing to prevent operation of a compression chamber disposed within the housing. For example, in a scroll compressor application, a conventional capacity modulation system may permit a non-orbiting scroll member to separate from an orbiting scroll member. Such separation creates a leak path between the non-orbiting scroll member and the orbiting scroll member and therefore reduces the ability of the compressor to compress refrigerant.

Leak paths may be accomplished by exposing the non-orbiting scroll member to low-pressure vapor (i.e., vapor at suction pressure) or to intermediate-pressure vapor or high-pressure vapor (i.e., vapor at discharge presue) through actuation of a valve. Pulse width modulation may be used to cycle the valve between an open state and a closed state to achieve a desired capacity of the compressor. Typically, the valve is cycled at a rate such that the valve is closed when the compressor is loaded and is open when the compressor is unloading.

During loading of the compressor, suction pressure at an inlet of the compressor steadily decreases, while during unloading of the compressor, suction pressure steadily increases. The decrease in suction pressure over time results in a reduction in capacity as the compressor is required to consume additional energy to compress the low-pressure vapor to discharge pressure when compared to the energy consumed in compressing vapor at a higher pressure (i.e., earlier during loading of the compressor). Therefore, the efficiency of the compressor decreases with decreasing suction pressure.

SUMMARY

A compressor system includes a compressor having an inlet, a first conduit fluidly coupled to the inlet, an accumulator fluidly coupled to the inlet by a second conduit, and a first valve disposed in the second conduit that prevents fluid communication between the accumulator and the inlet in a closed state and permits fluid communication between the accumulator and the inlet in an open state.

The first valve permits communication between the accumulator and the inlet of the compressor during loading of the compressor to increase the pressure of vapor received by the compressor generally at the end of an loading cycle (i.e., when vapor pressure is lowest). The increase in vapor pressure allows the compressor to consume less energy in compressing the vapor to discharge pressure and therefore increases the capacity and efficiency of the system.

BRIEF DESCRIPTION OF THE DRAWINGS

The present teachings will become more fully understood from the detailed description and the accompanying drawings, wherein.

DETAILED DESCRIPTION

Figure 1:
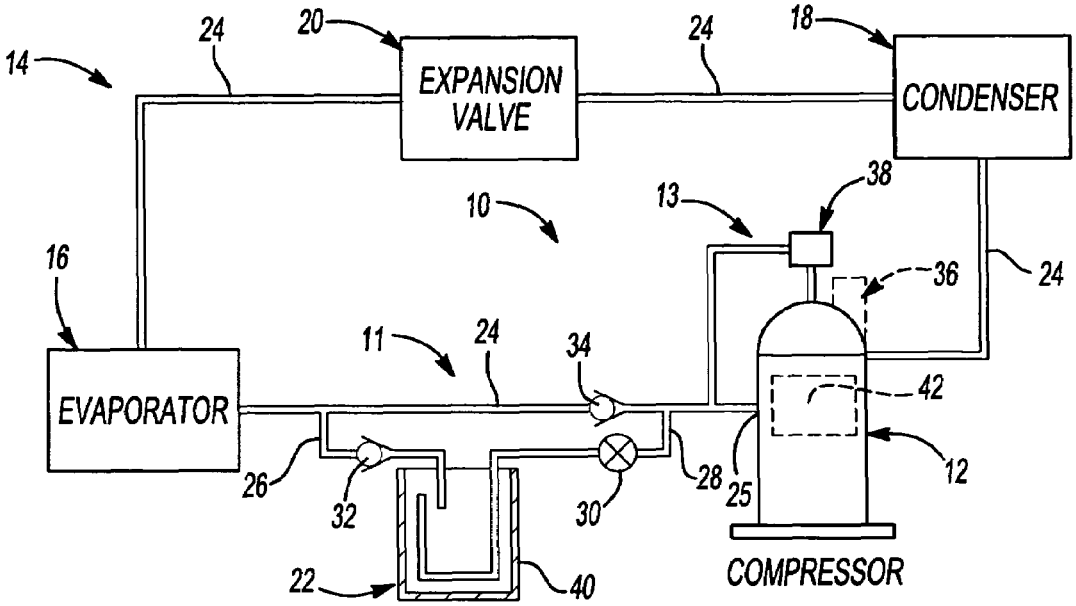
FIG. 1 is a schematic view of a heat pump or cooling system incorporating a capacity modulation system including a first capacity modulation circuit in accordance with the principles of the present teachings.

With reference to the drawings, a capacity modulation system 10 is provided for use with a compressor 12. The capacity modulation system 10 selectively loads and unloads the compressor 12 to tailor compressor capacity with system demand. The compressor 12 may be a scroll compressor incorporating an intermediate-pressure biasing system as shown in Assignee's U.S. Pat. No. 6,821,092 or may be a scroll compressor incorporating a discharge-pressure biasing system as shown in Assignee's U.S. Pat. No. 6,213,731, the disclosures of which are hereby incorporated herein by reference. While a scroll compressor is described in association with the capacity modulation system 10, the capacity modulation system 10 may be used with other compressor types, including a reciprocating compressor, such as the compressor shown in Assignee's U.S. Pat. No. 6,206,652, the disclosure of which is hereby incorporated herein by reference With particular reference to FIG. 1, the capacity modulation system 10 and compressor 12 are incorporated into a system 14 having an evaporator 16, a condenser 18, an expansion valve 20, and an accumulator 22. The system 14 may be a heat pump system, refrigeration system, chiller system, or HVAC system depending on the location of the evaporator 16 and the condenser 18.

The compressor 12 is fluidly coupled to the evaporator 16, condenser 18, expansion valve 20, and accumulator 22 by a main conduit 24. The compressor 12 and main conduit 24 cooperate to circulate refrigerant between the various components 16, 18, 20, 22 of the global system 14 to produce a cooling effect. The main conduit 24 extends between the various components 16, 18, 20, 22 and is fluidly coupled to an inlet 25 of the compressor 12 to provide the compressor 12 with vaporized refrigerant.

In operation, the compressor 12 receives vapor refrigerant from the evaporator 16 and compresses the vapor prior to discharging, the compressed vapor to the condenser 18. The condenser 18 extracts heat from the refrigerant, thereby causing the vapor refrigerant to change state from a vapor to a liquid. The liquid refrigerant is pumped from the condenser 18 to the expansion valve 20 under pressure from the compressor 12.

The expansion valve 20 expands the liquid refrigerant prior to the refrigerant entering the evaporator 16 to increase the ability of the refrigerant to absorb heat. The evaporator 16 extracts heat from its surroundings, thereby converting the liquid refrigerant from a liquid to a vapor. Once in the vapor state, the refrigerant is returned to the compressor 12 to start the cycle anew.

The capacity modulation system 10 generally includes a vapor compensation circuit 11 and a capacity modulation circuit 13. The vapor compensation circuit 11 is generally disposed between the evaporator 16 and the compressor 12 and selectively supplies the compressor 12 with vaporized refrigerant at a slightly higher pressure than the suction pressure being supplied through the main conduit 24.

The vapor compensation circuit 11 includes an input conduit 26, an outlet conduit 28, and a valve 30. The input conduit 26 fluidly couples the accumulator 22 to the main conduit 24 and includes a check valve 32. The check valve 32 is disposed proximate to an inlet of the accumulator 22 to prevent refrigerant from exiting the accumulator 22 and traveling into the evaporator 16. The outlet conduit 28 fluidly couples the accumulator to main conduit 24 and includes valve 30. Valve 30 may be an ON-OFF valve such as, for example, a solenoid valve. While a solenoid valve is disclosed, any valve capable of selectively preventing flow from the accumulator 22 to the compressor 12, such as a thermal expansion valve or an electronic expansion valve, may be used.

A check valve 34 is generally disposed at a junction of outlet conduit 28 and main conduit 24. The check valve 34 prevents vapor from the accumulator 22 from traveling along main conduit 24 generally toward the evaporator 16. The check valve 34 ensures that vapor from the accumulator 22 is directed away from the evaporator 16 and toward the compressor 12.

Figure 1A:
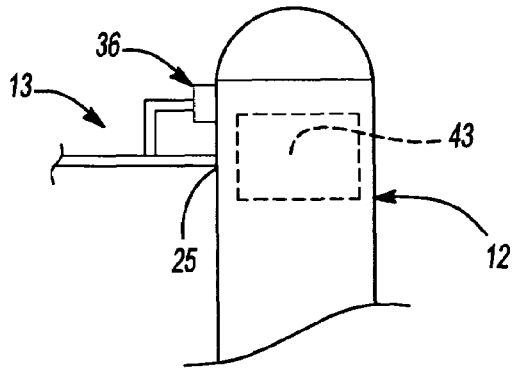
FIG. 1A is a schematic view of a second capacity modulation circuit for use with the capacity modulation system of FIG. 1.

The capacity modulation circuit 13 may be a pressure biasing circuit, such as an intermediate-pressure biasing system 36 or a discharge-pressure biasing system 38, to selectively load and unload the compressor 12, as described in Assignee's U.S. Pat. No. 6,821,092 and Assignee's U.S. Pat. No. 6,213,731, respectively. The discharge-pressure biasing system 38 is shown schematically in FIG. 1 while the intermediate-pressure biasing system 36 is shown in FIG. 1A. While either pressure biasing system 36, 38 may be used in conjunction with the capacity modulation system 10, the capacity modulation system 10 will be described hereinafter as including the discharge-pressure biasing system 38.

As shown in the drawings, operation of the capacity modulation system 10 includes converting refrigerant from a liquid to a vapor at the evaporator 16, whereby the vaporized refrigerant travels from the evaporator 16 toward the compressor 12 along the main conduit 24 to the inlet 25 of the compressor 12 and the inlet conduit 26 of the accumulator 22.

The accumulator 22 receives the vaporized refrigerant and collects vaporized refrigerant in a tank 40. Once in the tank 40, the vaporized refrigerant is separated into a low-pressure liquid and a vapor at a slightly higher pressure, but at a lower pressure than both intermediate pressure and discharge pressure of the compressor 12. The liquid refrigerant collects at a bottom of the tank 40 while the vapor refrigerant rises to a top of the tank 40. The vapor refrigerant exits the accumulator 22 via conduit 28 and enters the compressor 12 at inlet 25 when the valve 30 is in an open state. The vapor refrigerant remains in the accumulator 22 when the valve 30 is in a closed state.

Operation of the valve 30 may be controlled using pulse width modulation to cycle the valve 30 between the open state and the closed state. The valve 30 is timed with operation of the discharge-pressure biasing system 38 such that when the discharge-pressure biasing system 38 loads the compressor 12, the valve 30 is in the open state for at least a portion of the compressor loading.

Figure 2:
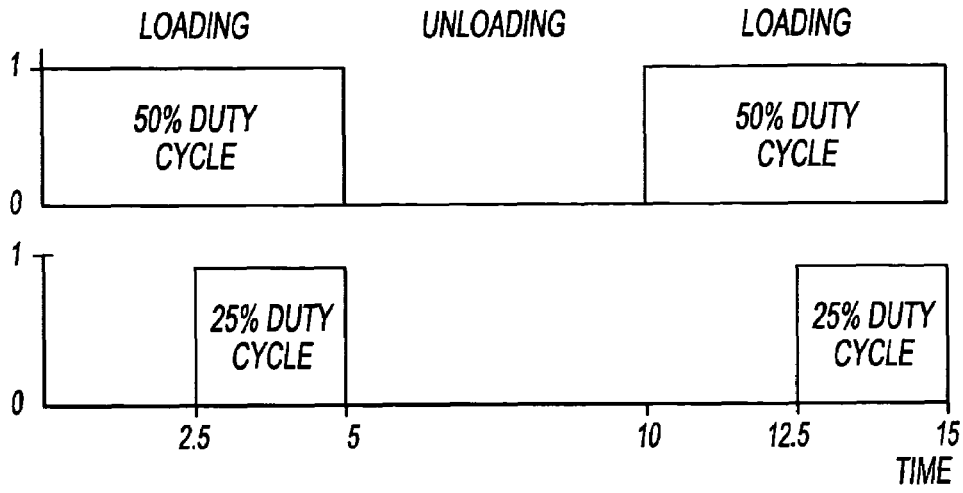
FIG. 2 is a waveform diagram illustrating variable duty cycle signals of a first valve and a second valve for use with the capacity modulation system of FIG. 1.

FIG. 2 depicts an exemplary duty cycle for the discharge-pressure biasing system 38 and the valve 30. The duty cycle depicts the discharge-pressure biasing system 38 as loading the compressor 12 for five seconds and unloading the compressor for five seconds for a total cycle time of ten seconds. While a duty cycle of ten seconds is disclosed, the discharge-pressure biasing system 38 and the valve 30 may include a shorter or longer duty cycle.

In a scroll compressor application, the discharge-pressure biasing system 38 selectively supplies vapor at discharge pressure to a biasing chamber 42 of the compressor 12 to maintain engagement of a non-orbiting scroll member with an orbiting scroll member. Maintaining engagement between the non-orbiting scroll member and the orbiting scroll member allows the non-orbiting scroll member to cooperate with the orbiting scroll member to compress fluid therebetween.

During unloading of the compressor 12, vapor refrigerant at suction pressure is supplied to the biasing chamber 42 to allow the non-orbiting scroll member to separate from the orbiting scroll member. Separation of the non-orbiting scroll member from the orbiting scroll member creates a leak path between the non-orbiting scroll member and the orbiting scroll member. The leak path reduces the ability of the non-orbiting scroll member and the orbiting scroll member to compress fluid.

In a non-scroll compressor application, such as a reciprocating compressor, the valve may be disposed in fluid communication with main conduit 24 and is selectively actuated between an ON state permitting vapor refrigerant at suction pressure to enter a compression chamber 43 of the compressor 12 and an OFF state preventing vapor refrigerant at suction pressure from entering the compression chamber 43 of the compressor 12. Restricting vapor refrigerant to the compression chamber 43 reduces the capacity of the compressor 12 when system demand is low and therefore improves the efficiency of the compressor 12 and system 14.

The duty cycle of the valve is shorter than the duty cycle of the discharge-pressure biasing system 38, but is timed such that when suction pressure being introduced to inlet 25 through main conduit 24 is at its lowest (e.g., the last 2.5 seconds of the five second loading period), the valve 30 is opened to allow vaporized refrigerant to enter the compressor 12 at inlet 25. The influx of vaporized refrigerant at a suction pressure higher than suction pressure on main conduit 24 increases the capacity of the compressor 12 without requiring the compressor 12 to consume additional energy.

The compressor 12 consumes additional energy in compressing reduced-pressure vaporized refrigerant to discharge pressure. Because suction pressure decreases with time during loading of the compressor 12, the compressor 12 consumes additional energy in compressing the reduced-pressure vapor refrigerant to discharge pressure. The additional energy consumption reduces the efficiency of the compressor 12 and therefore increases operational costs. When the valve 30 is in the open state (i.e., in the exemplary duty cycle at 2.5 seconds), suction pressure at the compressor inlet 25 increases when compared to a conventional system. The increase in suction pressure reduces the work required by the compressor 12 in compressing the vaporized refrigerant to discharge pressure. Reducing the work required by the compressor 12 in providing vaporized refrigerant at discharge pressure reduces energy consumption of the compressor 12 and therefore increases compressor efficiency.

Figure 3:
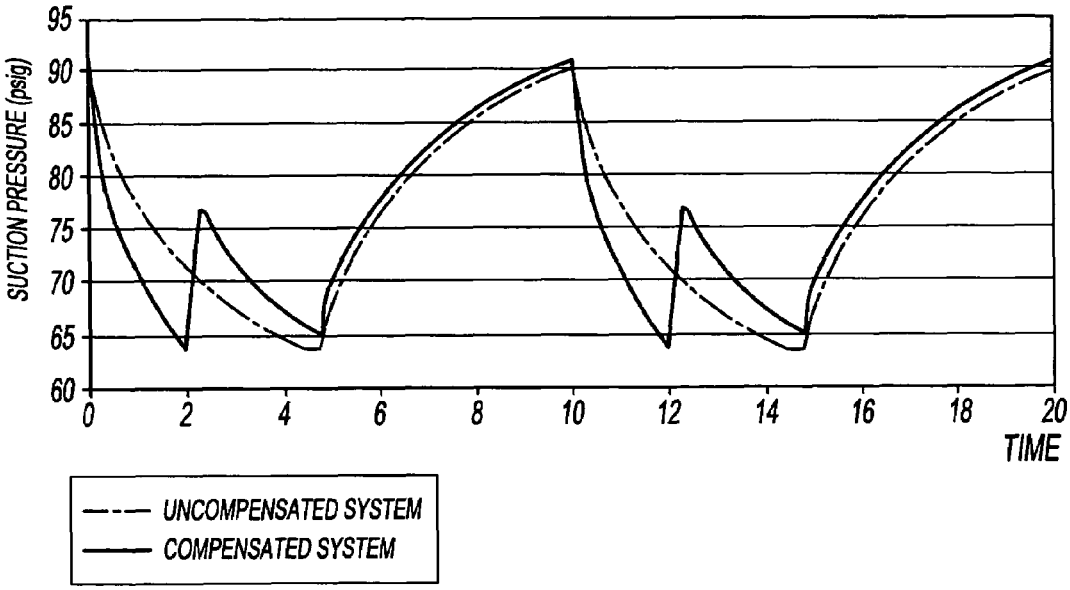
FIG. 3 is comparison of suction pressure versus time for a conventional capacity modulation system and a capacity modulation system of the present teachings.

FIG. 3 provides an exemplary plot illustrating the additional capacity realized by the compressor 12 when the valve 30 is in the open state during loading of the compressor 12. The plot of FIG. 3 indicates an increase in suction pressure from roughly 70 psig to roughly 78 psig when the valve 30 is open. The increase in suction pressure increases the capacity of the compressor 12 without requiring additional energy consumption.

In operation, the valve 30 is in the closed state when the compressor is initially loaded. When the compressor 12 is loaded for a predetermined time (i.e., 2.5 seconds in the exemplary duty cycle of FIG. 2), the valve 30 is opened and high-pressure vaporized refrigerant is permitted to flow from the accumulator 22 to the compressor inlet 25 via outlet conduit 28. While the vaporized refrigerant from the accumulator 22 also encounters the discharge-pressure biasing system 38, it does not affect the ability of the system 38 to maintain the compressor 12 in the loaded state as the high-pressure vaporized refrigerant from the accumulator 22 is at a lower pressure than the vaporized refrigerant at discharge pressure applied to the compression chamber 42.

Once the discharge-pressure biasing system 38 has loaded the compressor 12 for a predetermined time (i.e., five seconds in the exemplary duty cycle of FIG. 2), the compressor 12 is unloaded. At approximately the same time, the valve 30 is closed such that the compressor 12 only receives vaporized refrigerant from main conduit 24. At this point, the compressor 12 remains in the unloaded state until the discharge-pressure biasing system 38 returns the compressor 12 to the loaded state and the cycle is started anew.

The capacity modulation system 10 works in conjunction with the pressure biasing system 36, 38 to tailor compressor capacity with demand. The capacity modulation system 10 controls vaporized refrigerant from the accumulator 22 through pulse width modulation of the valve 30 generally disposed between an outlet of the accumulator 22 and the inlet 25 of the compressor 12. Such valve control increases the capacity and efficiency of the compressor 12.

The description of the teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A compressor system comprising:

a compressor having an inlet;

a first conduit fluidly coupled to said inlet;

an accumulator fluidly coupled to said inlet by a second conduit; and a first valve disposed in said second conduit and operable to prevent fluid communication of vapor refrigerant between said accumulator and said inlet in a closed state and permit fluid communication of vapor refrigerant between said accumulator and said inlet in an open state.

2. The compressor system of claim 1, further comprising a first check valve disposed in said first conduit to direct fluid from said accumulator to said inlet when said first valve is in said open state.

3. The compressor system of claim 1, further comprising a second check valve disposed at an inlet of said accumulator to prevent fluid from exiting said accumulator at said inlet.

4. The compressor system of claim 1, wherein said first valve is a solenoid valve.

5. The compressor system of claim 1, further comprising a modulation system operable to toggle said compressor between a loaded state and an unloaded state.

6. The compressor system of claim 5, wherein said first valve is in said open state when said compressor is in said loaded state and said first valve is in said closed state when said compressor is in said unloaded state.

7. The compressor system of claim 6, wherein a duty cycle of said first valve is less than a duty cycle of said modulation system.

8. A compressor system comprising:

a compressor having an inlet;

an accumulator fluidly coupled to said compressor;

a valve disposed between said accumulator and said compressor and operable to selectively prevent flow into said compressor to modulate a capacity of said compressor; and a modulation system operable to toggle said compressor between a loaded state and an unloaded state, said valve permitting flow into said compressor when said compressor is in said loaded state and operable to prevent flow into said compressor when said compressor is in said unloaded state.

9. The compressor system of claim 8, wherein said valve is controlled using pulse width modulation.

10. The compressor of claim 8, wherein said valve is a solenoid valve.

11. The compressor system of claim 8, wherein said valve is in an open state when said compressor is in said loaded state and said valve is in a closed state when said compressor is in said unloaded state.

12. The compressor system of claim 8, wherein a duty cycle of said valve is less than a duty cycle of said modulation system.

13. The compressor system of claim 8, wherein said modulation system is an intermediate-pressure biasing system.

14. The compressor system of claim 8, wherein said modulation system is a discharge-pressure biasing system.

15. The compressor system of claim 1, wherein said first conduit includes a first end coupled to said inlet and a second end coupled to an evaporator.

16. The compressor system of claim 8, further comprising a first conduit having a first end coupled to said inlet and a second end coupled to an evaporator.

17. The compressor system of claim 16, further comprising a second conduit fluidly coupling said accumulator to said inlet, said valve being disposed in said second conduit.

18. A compressor system comprising:

a compressor having an inlet;

a first conduit fluidly coupled to said inlet;

an accumulator fluidly coupled to said inlet by a second conduit; and a pulse-width modulated valve disposed in said second conduit and operable to prevent fluid communication between said accumulator and said inlet in a closed state and permit fluid communication between said accumulator and said inlet in an open state using pulse-width modulation.

19. The compressor system of claim 18, further comprising a first check valve disposed in said first conduit to direct fluid from said accumulator to said inlet when said pulse-width modulated valve is in said open state.

20. The compressor system of claim 18, further comprising a second check valve disposed at an inlet of said accumulator to prevent fluid from exiting said accumulator at said inlet.

21. The compressor system of claim 18, wherein said pulse-width modulated valve is a solenoid valve.

22. The compressor system of claim 18, further comprising a modulation system operable to toggle said compressor between a loaded state and an unloaded state.

23. The compressor system of claim 22, wherein said pulse-width modulated valve is in said open state when said compressor is in said loaded state and said pulse-width modulated valve is in said closed state when said compressor is in said unloaded state.

24. The compressor system of claim 23, wherein a duty cycle of said pulse-width modulated valve is less than a duty cycle of said modulation system.

25. The compressor system of claim 18, wherein said first conduit includes a first end coupled to said inlet and a second end coupled to an evaporator.

* * * * *

UNITED STATES PATENT AND TRADEMARK OFFICE

CERTIFICATE OF CORRECTION

PATENT NO. : 7,584,625 B2
APPLICATION NO. : 11/256636
DATED : September 8, 2009
INVENTOR(S) : Wu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 972 days.

Signed and Sealed this

Fourteenth Day of September, 2010

David J. Kappos

David J. Kappos
*Director of the United States Patent and Trademark Office*